US007361152B2

(12) United States Patent
Sanada et al.

(10) Patent No.: US 7,361,152 B2
(45) Date of Patent: Apr. 22, 2008

(54) CORRUGATED MATTRESS VIBRATOR LONGITUDINALLY VIBRATED

(75) Inventors: Hiromi Sanada, 5-11-80, Kodatsuno, Kanazawa-shi, Ishikawa (JP); Mitsuyoshi Ito, Chiba (JP)

(73) Assignees: Matsuda Micronics Corporation, Kashiwa-shi (JP); Hiromi Sanada, Kanazawa-shi (JP)

( * ) Notice: Subject to any disclaimer, the term of this patent is extended or adjusted under 35 U.S.C. 154(b) by 580 days.

(21) Appl. No.: 10/948,127

(22) Filed: Sep. 24, 2004

(65) Prior Publication Data

US 2006/0069327 A1 Mar. 30, 2006

(51) Int. Cl.
*A61H 23/02* (2006.01)

(52) U.S. Cl. ..... 601/46; 601/58; 601/59

(58) Field of Classification Search ..... 601/58, 601/59, 49–51, 46, 48, 56, 57, 60, 78, 82, 601/83; 5/915
See application file for complete search history.

(56) References Cited

U.S. PATENT DOCUMENTS

| | | | | |
|---|---|---|---|---|
| 2,512,621 | A * | 6/1950 | Emerson | 601/58 |
| 2,852,020 | A * | 9/1958 | Murphy | 601/15 |
| 2,902,993 | A * | 9/1959 | Wagner | 601/58 |
| 2,917,043 | A * | 12/1959 | Murphy | 601/58 |
| 3,019,784 | A * | 2/1962 | Eiden | 601/58 |
| 3,019,785 | A * | 2/1962 | Eiden | 601/58 |
| 3,068,858 | A * | 12/1962 | Suarez | 601/58 |
| 3,092,099 | A * | 6/1963 | Berard | 601/58 |
| 3,335,717 | A * | 8/1967 | Monaco | 601/58 |
| 3,831,591 | A * | 8/1974 | Newkirk | 601/58 |
| 5,442,710 | A | 8/1995 | Komatsu | 381/24 |

FOREIGN PATENT DOCUMENTS

| | | |
|---|---|---|
| DE | 1133858 | 7/1962 |
| EP | 0684031 A1 | 11/1995 |

OTHER PUBLICATIONS

European Search Report dated May 10, 2005.

* cited by examiner

*Primary Examiner*—Danton DeMille
(74) *Attorney, Agent, or Firm*—Kratz, Quintos & Hanson, LLP

(57) ABSTRACT

A mattress vibrator comprises a mat having a hard plate and an elastic plate which are laminated on each other, and the mat is provided with a vibration generator, a vibrator which generates vibration by operating a moving body in an axial direction of the vibrator is used as the vibration generator, the vibrator is disposed on substantially a central portion of one end of the hard plate, an axis of the vibrator is disposed within a plate thickness of the hard plate.

2 Claims, 3 Drawing Sheets

CORRUGATED MATTRESS VIBRATOR LONGITUDINALLY VIBRATED

TECHNICAL FIELD

The present invention relates to a mattress vibrator which promotes blood flow and suppresses reactive oxygen species by utilizing vibration so as to prevent and treat the pressure ulcer.

BACKGROUND TECHNIQUE

The pressure ulcer is one of important problems of modern medicine. Since a bedridden person is more likely to develop the pressure ulcer, the pressure ulcer is a different sick when he or she was admitted to hospital, and the pressure ulcer is developed during staying in the hospital. The pressure ulcer increases the staying period in the hospital, and caregiving of the patient having pressure ulcers becomes burdensome to a nurse or his or her family.

In general, cleasing and ointment application to the wounds promote the wound healing. Additionally, pressure relief is the most effective technique. When blood flow disturbance bony prominence over a sacram, heel or shoulder occurs due to friction, shear or compression. Therefore, it is an effective treatment to remove a pressure so that a pressure is not applied to that region.

Many types of support surface such as air, foam, and gel mattress are used in hospital.

Pressure relief reduction makes it difficult to generate the congestion, but can not promote the blood flow. Therefore, it is necessary to take some treatments to promote the blood flow for a pressure ulcer. Therefore, it is necessary to take some treatment for pressure ulcers.

One of measures to prevent the pressure ulcer is to disperse a body pressure by vibration (e.g., patent document 1).

[Patent Document 1]

Japanese Patent Application Laid-open No. H11-76319

Although blood flow is promoted by vibration, vertical vibration causes uneasiness to the human tissue. Further, free radicals generated at the same time affects a human tissue, and this is one of causes that delay the recovery from the pressure ulcer.

Thereupon, it is an object of the present invention to provide a mattress vibrator capable of more positively recovering from a pressure ulcer or preventing the pressure ulcer by removing a pressure acting on a portion of a human tissue where a pressure ulcer is prone to be generated or has been already generated pressure ulcer by vibrating such portion without giving uneasiness, and by promoting blood flow and suppressing reactive oxygen species.

DISCLOSURE OF THE INVENTION

A first aspect of the present invention provides a mattress vibrator comprising a mat having a hard plate and an elastic plate which are laminated on each other, and the mat being provided with a vibration generator, wherein a vibrator which generates vibration by operating a moving body in an axial direction of the vibrator is used as the vibration generator, the vibrator is disposed on substantially a central portion of one end of the hard plate, an axis of the vibrator is disposed within a plate thickness of the hard plate.

According to this aspect, vibration which displaces the hard plate in one direction can efficiently be applied. Therefore, vibration can be applied to an affected portion of a human tissue and its periphery without giving uneasiness, and blood flow can be promoted and free radicals can be suppressed at the same time.

A second aspect of the invention provides a mattress vibrator comprising a mat having a hard plate and an elastic plate which are laminated on each other, the mat being provided with a vibration generator, and the hard plate being displaced in one direction by the vibration generator, wherein the mattress vibrator is disposed under a mattress of a bed such that a direction of displacement of the hard plate is horizontal with respect to a surface of the bed and is perpendicular to a longitudinal direction of the bed.

According to this aspect, vibration can be applied to an affected portion of a human tissue and its periphery without giving uneasiness, and blood flow can be promoted and free radicals can be suppressed at the same time.

According to a third aspect, in the mattress vibrator of the first or second aspect, the vibration generator gives amplitudes including a first amplitude and a second amplitude which is greater than the first amplitude.

According to this aspect, blood flow can be promoted and free radicals can be suppressed effectively at the same time.

BEST MODE FOR CARRYING OUT THE INVENTION

A mattress vibrator according to an embodiment of the present invention will be explained with reference to the drawings.

Figure 1:
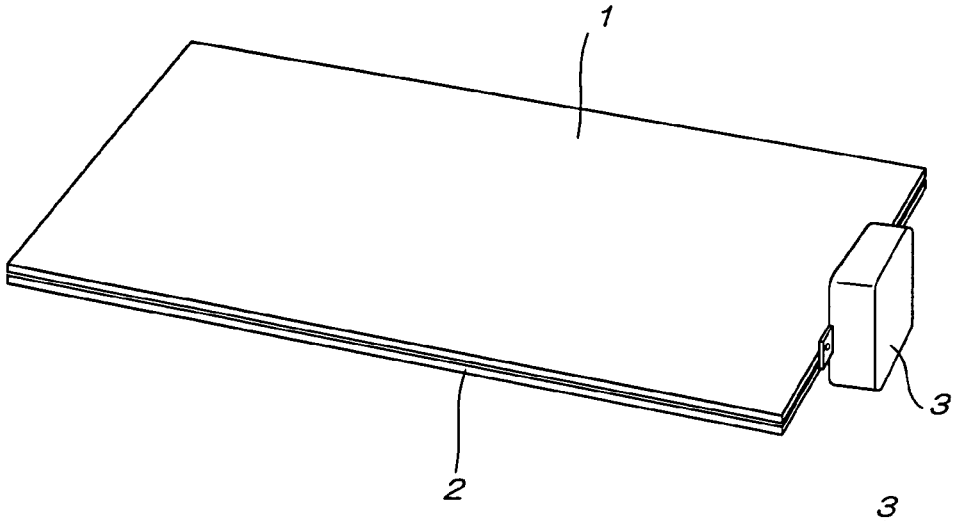
FIG. 1 is a perspective view of a mattress vibrator according to an embodiment of the present invention.
Figure 2:
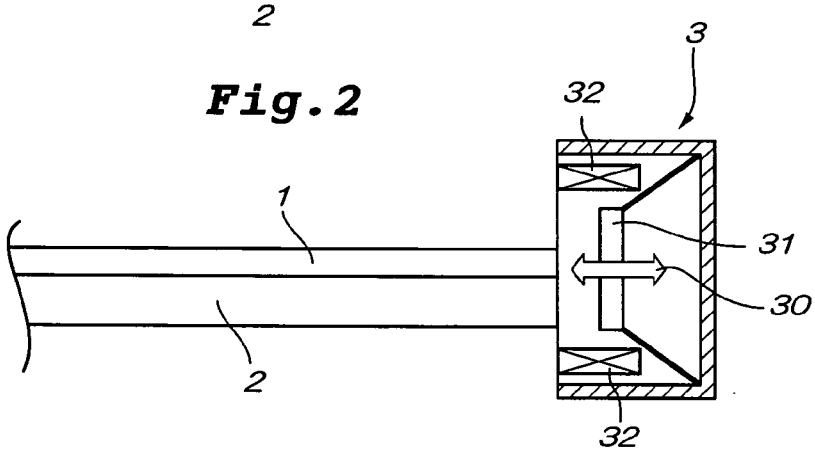
FIG. 2 is a side sectional view of an essential portion of the mattress vibrator of the embodiment.
Figure 3:
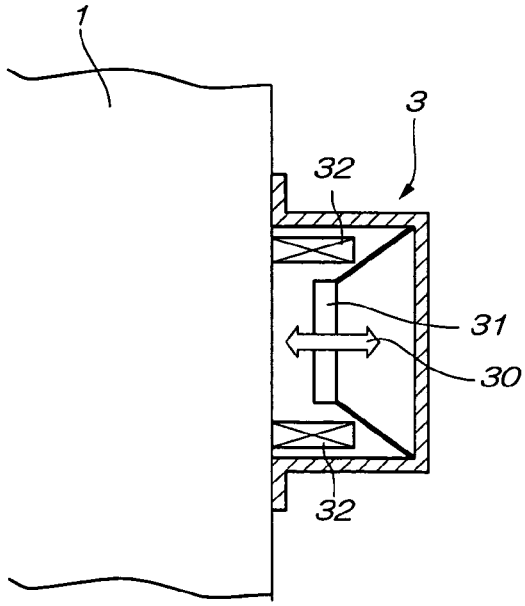
FIG. 3 is a plan sectional view of an essential portion of the mattress vibrator of the embodiment.

FIG. 1 is a perspective view of a mattress vibrator according to the embodiment, FIG. 2 is a side sectional view of an essential portion of the mattress vibrator, and FIG. 3 is a plan sectional view of an essential portion of the mattress vibrator.

The mattress vibrator of the embodiment includes a mat having a hard plate 1 and an elastic plate 2 which are laminated on each other, and a vibration generator 3 attached to the mat.

The hard plate 1 has sufficient rigidity for transmitting vibration. The hard plate 1 is a flat plate or a corrugated plate having a plurality of grooves and peaks in a displacement direction. The elastic plate 2 is laminated on one surface of the hard plate 1, and is made of elastic vibration absorbing material. For example, as the hard plate 1, a plastic plate or a carbon fiber plate having a width of 400 mm, a length of 900 mm and a thickness of 3 mm is used. As the elastic plate 2, an urethane plate having a width of 400 mm, a length of 900 mm and a thickness of 150 mm is used.

The vibration generator 3 is mounted such that it is located at substantially central portion of one end of the hard plate 1, and an axis of the vibration generator 3 is located within a plate thickness of the hard plate 1.

The structure of the vibration generator used for the mattress vibrator according to the embodiment will be explained using FIGS. 2 and 3.

The vibration generator 3 of this embodiment uses a vibrator which generates vibration by operation of a moving body 31 in its axial direction 30. The moving body 31 is displaced by energizing a coil 32. The vibration generator 3 generates vibration by different amplitudes including first amplitude and second amplitude which is greater than the first amplitude. Especially, the vibration generator 3 generates the second amplitude between the first amplitudes, and repeatedly generates the first amplitudes and the second amplitudes at predetermined intervals. It is not always necessary that the first amplitude and the second amplitude are generated at regular intervals, and another amplitude having different magnitude may be included between the first amplitude and the second amplitude.

A using state of the mattress vibrator according to the embodiment will be explained using FIGS. 4 to 6.

Figure 4:
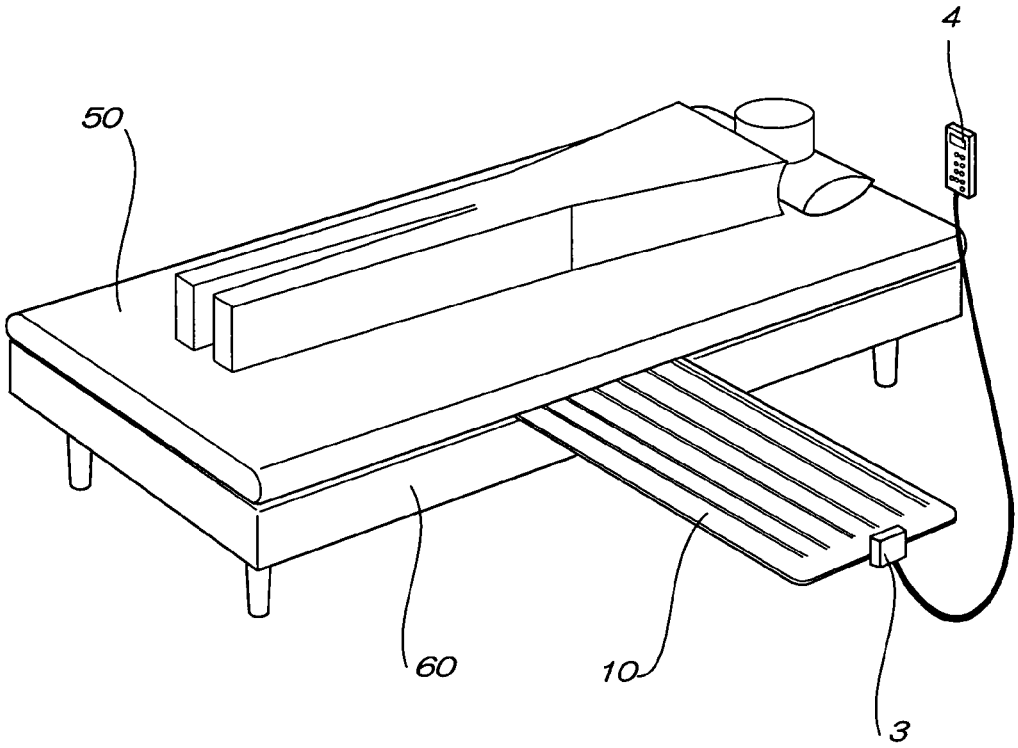
FIG. 4 is a perspective view showing a mounting method of the mattress vibrator of the embodiment on a bed.

FIG. 4 is a perspective view showing a mounting method of the mattress vibrator of the embodiment on a bed.

As shown in the drawings, the mattress vibrator 10 according to the embodiment is inserted between a bed 60 and a mattress 50. It is preferable that a length of the mattress vibrator 10 is slightly longer than a width of the bed 60. This is because that vibration generated by the mattress vibrator 10 can efficiently be transmitted to the mattress 50 by holding the mattress vibrator 10 by frames located on opposite side surfaces of the bed 60. The mattress vibrator 10 has a controller 4, and the controller 4 is disposed bedside.

As shown in FIG. 4, the mattress vibrator 10 is disposed under a lower surface of a portion of the mattress 50. Therefore, only the portion of the mattress 50 where the mattress vibrator 10 is disposed is displaced perpendicular to a longitudinal direction of the mattress 50 in the horizontal direction with respect to an upper surface of the mattress 50. Thus, when the mattress 50 is disposed in the vicinity of a hip of a human tissue as shown in FIG. 4, a rolling motion, i.e., a lateral vibration is given only to the hip.

Although the mattress vibrator 10 is disposed at substantially a central portion of the mattress 50, i.e., in the vicinity of the hip of the human tissue in FIG. 4, the mattress vibrator 10 may be disposed under a portion of the mattress 50 closer to its one of ends, i.e., in the vicinity of a back or legs of the human tissue.

Figure 5:
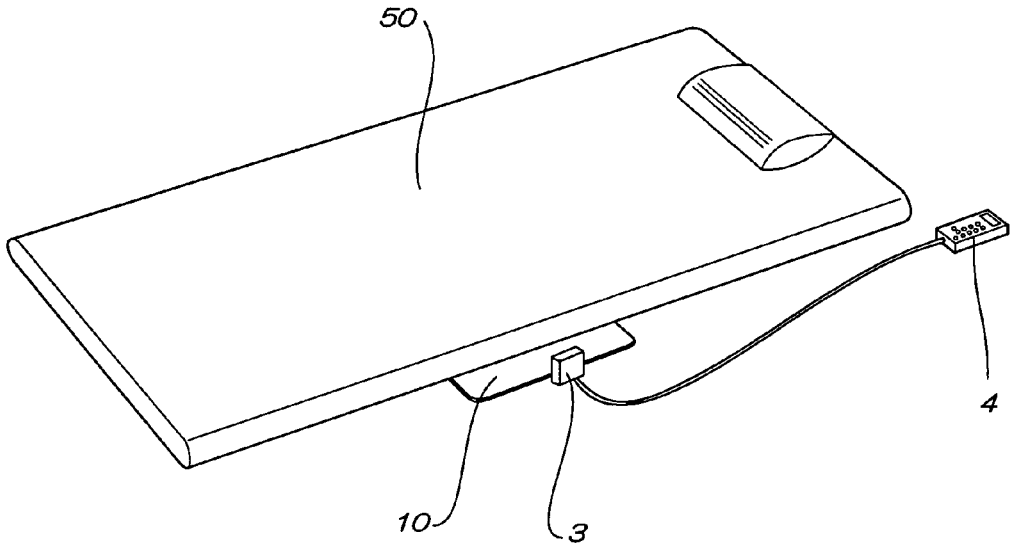
FIG. 5 is a perspective view showing a using state of the mattress vibrator of the embodiment.

FIG. 5 is a perspective view showing a using state of the mattress vibrator of the embodiment, and shows a state in which the bed is not used at home or in a care center.

As shown in FIG. 5, it is not always necessary to use a bed, the mattress 50 may be disposed on a floor or a tatami floor, and the mattress vibrator 10 may be disposed under the mattress 50.

Figure 6:
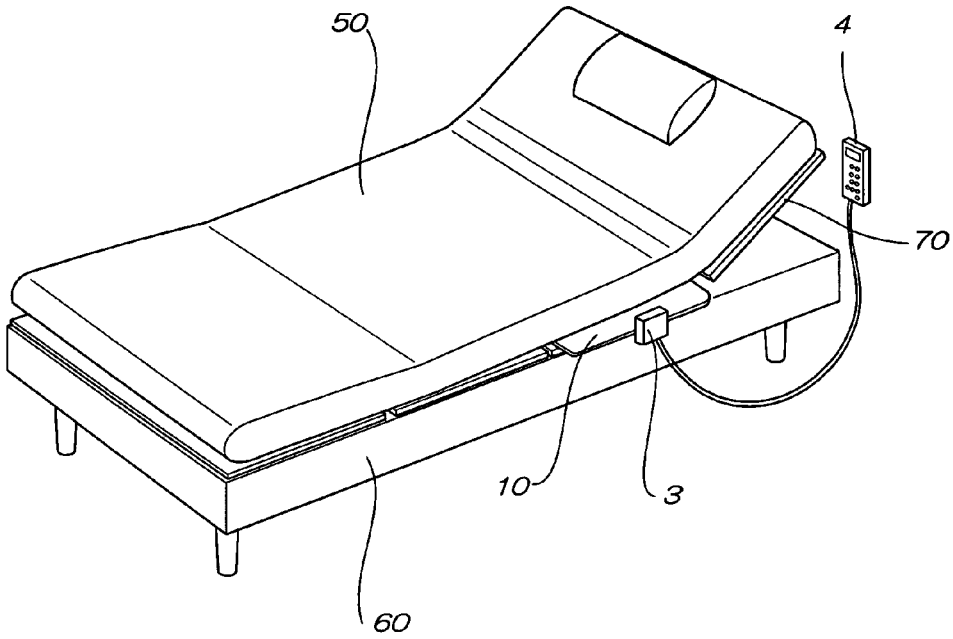
FIG. 6 is a perspective view showing another using state of the mattress vibrator of the embodiment.

FIG. 6 is a perspective view showing another using state of the mattress vibrator of the embodiment.

As shown in FIG. 6, the mattress vibrator 10 can also be applied to a bed 60 having a jack-up function which inclines a portion of the mattress 50.

When the mattress vibrator 10 is used for the bed 60 having the jack-up function as shown in FIG. 6, the mattress vibrator 10 is disposed under a portion of the mattress 50 that is not jacked up.

If the mattress vibrator 10 is used as shown in the embodiment, it is possible to suppress the reactive oxygen species which are harmful for a human tissue.

If the mattress vibrator of the embodiment is used, since vibration is transmitted and the affected part of the body is finely vibrated and thus, the blood flow is promoted. Since the blood flow is promoted and the reactive oxygen species is suppressed, curing effect of the affected part of the body is enhanced.

Most hospitals use metal beds. Since vibration is absorbed by the elastic plate 2, vibration sound can be absorbed and reduced to very small value.

The mattress vibrator of this embodiment can be used for a conventional bed as it is, the mat is light in weight and can easily be carried, the mat can be used repeatedly in a hospital and can be used at home.

According to this embodiment, as described above, an existing bed for dispersing a body pressure can be used in a hospital or at home as it is, it is possible to apply fine vibration to an air mattress or an urethane sofa, since the blood flow of the affected portion of the body is promoted and free radicals are suppressed, the curing effect of pressure ulcer is enhanced.

According to the present invention, it is possible to more positively recover from a pressure ulcer or to prevent the pressure ulcer by promoting blood flow and suppressing free radicals using vibration without giving uneasiness.

The invention claimed is:

1. A mattress vibrator comprising a mat having a hard plate (1) and an elastic plate (2) which are laminated on each other, in which a vibration generator (3) is disposed on one end of said hard plate (1) in its longitudinal direction, wherein said vibration generator (3) has a moving body (31) whose axial direction corresponds to the longitudinal direction of said hard plate (1), said hard plate (1) comprises a corrugated plate having grooves and peaks in a displacement direction, said elastic plate (2) is laminated on one of the surfaces of said hard plate (1), and the other surface of said hard plate (1) is used as a surface on the side of a human using the mattress vibrator.

2. The mattress vibrator according to claim 1, further comprising a control operating system (4) for instructing vibration generator (3) to give amplitude including a first amplitude and a second amplitude which is greater than the first amplitude.

* * * * *